United States Patent [19]

Lewis

[11] 4,023,803

[45] May 17, 1977

[54] NUNCHAKU

[76] Inventor: Jack E. Lewis, 2832 S. 46 St., Phoenix, Ariz. 85040

[22] Filed: July 7, 1975

[21] Appl. No.: 593,756

[52] U.S. Cl. ..... 273/84; 403/135; 403/165; 403/78

[51] Int. Cl.² ..... F41B 15/02

[58] Field of Search ..... 272/76, 75, 57; 273/84 R, 67 R; 231/1–6; 403/135, 140, 165, 78

[56] References Cited

UNITED STATES PATENTS

| | | | |
|---|---|---|---|
| 149,710 | 4/1974 | Bell | 231/5 |
| 1,151,620 | 8/1915 | Schmidt | 231/2 R |
| 1,629,209 | 5/1927 | Fairbanks | 272/75 |
| 1,666,201 | 4/1928 | Goldstein | 272/75 |
| 3,363,898 | 1/1968 | Crovello | 272/75 |
| 3,454,274 | 7/1969 | Kaeshiro | 272/75 |
| 3,608,899 | 9/1971 | Hall | 273/84 |

FOREIGN PATENTS OR APPLICATIONS

| | | | |
|---|---|---|---|
| 1,109,242 | 1/1955 | France | 272/75 |
| 512,292 | 1/1955 | Italy | 272/75 |
| 755,736 | 8/1956 | United Kingdom | 272/75 |
| 26,028 | 12/1908 | United Kingdom | 272/75 |

*Primary Examiner*—Richard C. Pinkham
*Assistant Examiner*—T. Brown
*Attorney, Agent, or Firm*—James W. McFarland

[57] ABSTRACT

A nunchaku-type material arts self-defense weaponry having swivel bearings connecting opposite ends of a link chain to a pair of handles. The swivel connections allow continuous twisting or spinning of the handles relative to each other during use of the device without twisting or kinking the link chain.

11 Claims, 6 Drawing Figures

FIG-1
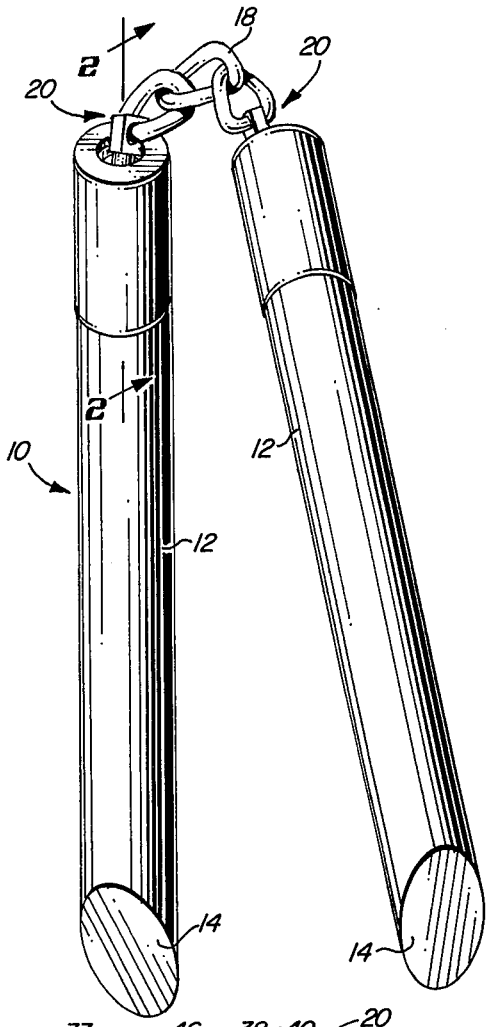
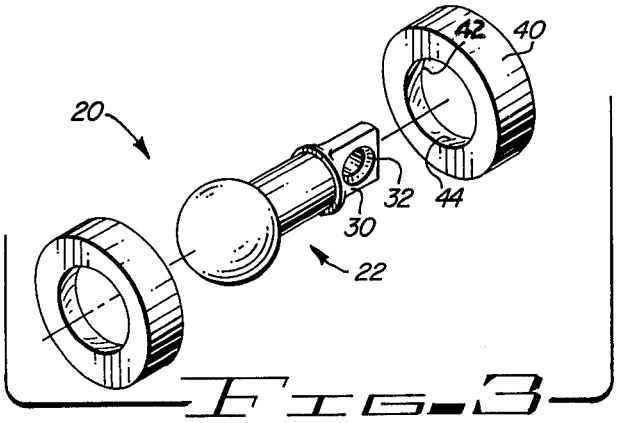
FIG-3
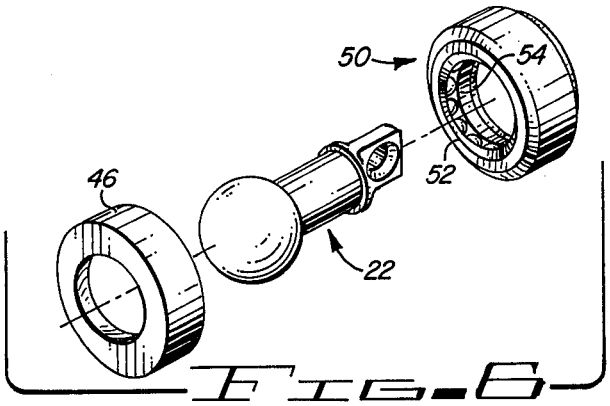
FIG-6
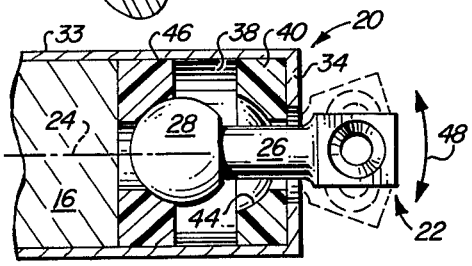
FIG-2
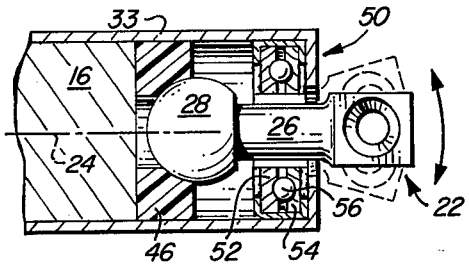
FIG-5
FIG-4
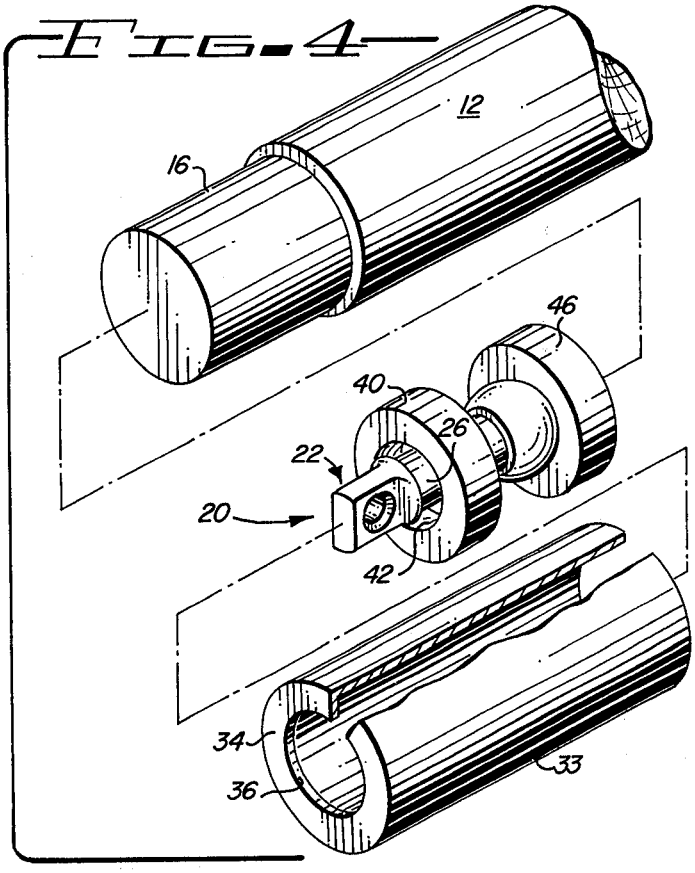

NUNCHAKU

BACKGROUND OF THE INVENTION

This invention relates to martial arts self-defense weaponry or excercising devices.

One type of such weaponry, conventionally designated as "nunchakus," includes a pair of handles interconnected by bendable linkage such as chain or strong roping. While grasping one handle, the other handle and chain may be swung to the side, around the body, above the head, and in a variety of other different actions to produce a highly effective hand weapon. Similarly, other manipulations of one or both handles make the nunchaku an extremely effective weapon when properly utilized. In the field of martial arts, the nunchaku develops great hand, wrist, arm, and body dexterity in its use both as a sport and exercising device. Also, because of its relative simplicity and compactness, the nunchaku is finding greater use as a self-defense hand weapon for law enforcement officials. With proper training, law enforcement officers may quickly develop the ability to immobilize subjects without inflicting serious or lethal blows.

At the same time, proper use of such devices requires numerous, rather complex movements, many of which rely upon spinning or twisting of the handles relative to one another to develop high momentum for strong blows with heavy impact. Other movements include rapid and complicated twisting of both handles simultaneously, this tending to cause repeated twisting and consequent kinking of the linkage connecting the handles. Similar results occur with other types of martial arts devices that incorporate more than two handle-like rigid members connected by bendable linkage in chain-like fashion.

SUMMARY OF THE INVENTION

It is an object of the present invention to provide an improved device of the class described which has greater durability and flexibility and is therefore adapted to a wider variety of intermittent or continuous manipulations.

It is an important object of the present invention to provide improved self-defense weaponry of the type described wherein various complicated motions of the handles may be accomplished without twisting or kinking of the bendable linkage connecting the handles.

More particularly, it is an object of the present invention to provide a pivotal bearing or swivel interconnecting each end of the linkage with the associated handle in a manner allowing the linkage to rotate relative to the elongated axes of the handle so that the handles may be relatively twisted without twisting or kinking the linkage.

A further object of the invention is to provide such a bearing connection that is sufficiently loosely retained at the end of each handle to permit several degrees of freedom of movement of the connections relative to the handles, yet which bearing connections are sufficiently strong to withstand the extreme stresses placed thereon during use of the device.

Briefly, the invention contemplates a nunchaku comprising a pair of handle members, one end of each being interconnected with opposite ends of chain linkage through a bearing or swivel connection. Each such connection includes a first element that is rotatable relative to the elongated central axis of the associated handle, and a second element that is secured to the end of the handle to present a shoulder relatively loosely retaining the first element to allow at least said rotation thereof relative to the handle. In preferred arrangements, the second element includes a hollowed cap rigidly secured to the end of the handle. The cap has an apertured transverse end wall spaced from the handle end, and a bearing disposed inside the cap rotatably and relatively loosely receives a pivot formed on an inner end of the first element. The chain interlinks with an eyelet at the outer end of the first element.

These and other more particular objects and advantages of the present invention are specifically set forth in or will become apparent from the following detailed description of preferred embodiments of the invention when read in conjunction with the accompanying drawing.

BRIEF DESCRIPTION OF THE DRAWING

In the drawing:

FIG. 1 is a perspective view of a nunchaku-type self-defense weapon incorporating the present invention;

FIG. 2 is a transverse cross-sectional view of the end portion of the handle and the bearing means, as viewed along lines 2—2 of FIG. 1;

FIG. 3 is an exploded perspective view of the bearing elements of FIG. 2;

FIG. 4 is an exploded perspective view of the bearing elements, end cap and handle end;

FIG. 5 is a cross-sectional view similar to FIG. 2 but showing an alternate embodiment of bearing means; and FIG. 6 is an exploded perspective view similar to FIG. 3 but showing the bearing element of the FIG. 5 embodiment.

DETAILED DESCRIPTION OF THE PREFERRED EMBODIMENTS

Referring now to the drawing and more particularly to FIGS. 1–4, there is illustrated self-defense weaponry of the nunchaku type generally denoted by the numeral 10. The nunchaku includes a pair of identical handle members 12 preferably constructed of relatively dense, strong wood material. Each handle member is slightly tapered from its larger diameter truncated end 14 toward the smaller, stepped-diameter end 16. Extending between ends 16 is bendable linkage in the form of a metallic link chain 18 having opposite end links connected to handle ends 16 by separate bearing or swivel means generally denoted by the numeral 20. While the chain 18 illustrated in FIG. 1 is shown with only three links, it will be understood that the chain may be substantially longer; however, most such devices incorporate a chain or equivalently bendable, heavy nylon or hemp roping of an effective length substantially less than the length of handles 12.

One bearing arrangement is illustrated in detail in FIGS. 2–4; however, it is to be understood that identical bearing structure is incorporated at end 16 of each handle 12. Bearing means 20 includes a first elongated element 22 generally aligned with the elongated central axis 24 of the associated handle 12. Element 22 is preferably made of steel and has a central elongated stretch 26 between an inner end having a pivot in the form of a spherically configured section 28 of greater diameter than stretch 26, and an outer flattened end section 30 of the element 22 wherin is provided an eyelet 32. Each eyelet 32 is interlinked with the end links of chain 18.

The bearing means 20 further includes a second element that comprises a metallic, cylindrical, hollowed end cap 33 rigidly and nonrotatably affixed to the associated handle end 16. Cap 33 presents a shoulder in the form of a transverse end wall 34 having a central aperture 36 through which the smaller diameter stretch 26 extends to locate the first element pivot section 28 within an end space 38 inside cap 33 between handle end 16 and wall 34. The second element further includes a bearing in the form of an annularly shaped segment 40 of relatively soft bearing material such as nylon or similar plastic bearing material. Segment 40 has a central opening 42 through which stretch 26 extends, and a spherical, socket-like depression 44 on its inwardly facing surface. Depression 44 is complementally configured to pivot section 28 to rotatably receive the latter.

A second bearing segment 46 similar to segment 40 with a spherical socket depression is also preferably included within end space 38 between handle end 16 and pivot section 28. Segment 46 is also of a relatively soft bearing material, and for more economical manufacture it may be identical to annular segment 40.

The nunchaku is assembled with pivot section 28 retained within space 38 between bearing segments 40 and 46 so as to rotate upon the socket depressions about axis 24. The distance between segments 4 and 46 preferably allows slight axial movement of element 22; however, the device may be constructed with pivot 28 snugly, but movably, received in the depressions of the bearing sections.

In use, one or both handles may be firmly grasped, and a variety of swinging, twisting or rotating relative motions between the handles may be effected. The pivoting and rotation of elements 22 relative to the central axis 24 of the associated handles permits the above-described relative motions between the handles without twisting of chain 18. Accordingly, the links of chain 18 do not kink, and movements of the handles may be continued as desired without need for stopping simply to "straighten out" the chain. Further, the permitted rotation of element 22 affords a greater variety of continuous or intermittent movements. Because stretch 26 is of substantially less diameter than both segment opening 42 and wall aperture 36 and is therefore somewhat loosely retained within space 38, element 22 can tilt relative to axis 24 as depicted by arrows 48. This tilting action, along with the spacing between segments 40 and 46, further enhances the versatility of use and action of the nunchaku.

FIGS. 5 and 6 illustrate another form of the invention which incorporates much of the same structure of the FIG. 1 embodiment, as noted by the like numerals for the same structure, but depicts another form of bearing segment 50 in place of bearing segment 40. Bearing segment 50 includes an axial thrust roller bearing having races 52 and 54 with a plurality of ball bearings 56 therebetween. Race 54 operably engages end cap 33, and race 52 is engageable with pivot section 28 so as to permit free rotation of element 22 relative to the handle central axis 24. Stretch 26 is again of lesser diameter than the central opening of segment 50 inside races 52 and 54 to allow tilting of element 22.

Both arrangements of the inventions provide an economical structure incorporating a pivotal bearing element that allows relative twisting of the handles without twisting the chain linkage 18. Yet the device is sufficiently rigid, strong and durable to withstand the extreme stresses imposed thereon during use.

While specific embodiments of the invention have been set forth in detail, it will be apparent that various modifications and alterations may be made. For instance, various other arrangements and structure of elements 20 and 22 may be utilized. Accordingly, the foregoing detailed description is to be considered exemplary in nature and not as limiting to the scope and spirit of the invention as set forth in the appended claims.

Having described the invention with sufficient clarity that those skilled in the art may make and use it, I claim:

1. Self-defense weaponry, comprising:

a pair of handle members having elongated central axes;

bendable linkage extending between first ends of each of said members;

separate bearing means pivotally mounted to each of said members at said first ends thereof, said linkage secured to said separate bearing means whereby said linkage is rotatable about said central axes to allow relative twisting of said members without twisting said linkage, each of said bearing means including first and second elements respectively secured to said linkage and the associated handle member, said first element having a pivot section and said second element having a shoulder to retain the pivot section on said associated handle member, said second element further including an annular bearing between said shoulder and said pivot section for rotatably engaging said pivot section; and a second bearing comprising a segment of relatively soft bearing material disposed between each of said pivot sections and said first ends of the handle members, said segments complementally configured to said pivot sections for rotatably engaging the latter.

2. Self-defense weaponry as set forth in claim 1, wherein said first elements are relatively loosely retained by said second elements to allow rotation and tilting of said first elements relative to said elongated axes of the associated handle members.

3. Self-defense weaponry as set forth in claim 2, wherein said second element is provided with a central opening, said first element including a stretch extending through said opening, said aperture being of substantially greater diameter than said stretch whereby said first element is tiltable relative to said elongated axis of the associated handle member.

4. Self-defense weaponry as set forth in claim 2, wherein each of said first elements is provided with an eyelet, said linkage being interlinked with said eyelets.

5. Self-defense weaponry as set forth in claim 4, wherein said linkage comprises a link chain having opposite end links interlinked with said eyelets of the first elements.

6. Self-defense weaponry as set forth in claim 4, wherein each of said first elements is an elongated element generally axially aligned with said central axis of the associated handle member and having inner and outer ends respectively disposed inwardly and outwardly of said first end of the associated handle member, said eyelet located at said outer end and said pivot section located at said inner end.

7. Self-defense weaponry as set forth in claim 6, wherein each of said second elements includes a hollowed cap secured to said first end of the associated handle member, said cap having an apertured outer transverse wall spaced from said first end of the associated handle member to define an end space between said first end and said wall, said first element extending through said apertured wall with said pivot section disposed within said end space, said transverse wall defining said shoulder, 8. Self-defense weaponry, comprising:

a pair of handle members having elongated central axes;

bendable linkage extending between first ends of each of said members;

separate bearing means pivotally mounted to each of said members at said first ends thereof, said linkage secured to said separate bearing means whereby said linkage is rotatable about said central axes to allow relative twisting of said members without twisting said linkage, each of said bearing means including a first element pivotal about said elongated axis of the associated handle member, said linkage having opposite ends secured to said first elements, each of said bearing means further including a second element retained by said associated handle member at said first end thereof, said second element having a shoulder to retain first element on said associated handle member, said first elements being relatively loosely retained by said second elements to allow rotation and tilting of said firs elements relative to said elongated axes of the associated handle members, each of said first elements is provided with an eyelet, said linkage being interlinked with said eyelets, j each of said first elements being an elongated element generally axially aligned with said central axis of the associated handle member and having inner and outer ends respectively disposed inwardly and outwardly of said first end of the associated handle member, said eyelet located at said outer end, and said first element being provided with a pivot section at said inner end rotatably retained by said second element, each of said second elements including a hollowed cap secured to said first end of the associated handle member, said cap having an apertured outer transverse wall spaced from said first end of the associated handle member to define an end space between said first end and said wall, said first element extending through said apertured wall with said pivot disposed within said end space, said transverse wall defining said shoulder, each of said second elements further including an annular bearing disposed in said end space between said pivot and said transverse wall, said pivot rotatably engaging said bearing; and a second bearing comprising a segment of relatively soft bearing material disposed in said end space between said pivot and said first end of the associated handle member, said segment having a socket depression complementally configured to said pivot for rotatably receiving the latter.

9. Self-defense weaponry as set forth in claim 8, wherein each of said annular bearings includes a roller thrust bearing having a pair of races, one of said races operably engaging said cap, and said pivot being rotatably carried by the other of said races.

10. Self-defense weaponry as set forth in calim 8, wherein each of said annular bearings includes an annular segment of relatively soft bearing material having a surface complementally configured to said pivot for rotatably receiving the latter.

11. Self-defense weaponry as set forth in claim 10, wherein said pivot comprises a spherically configured section at said inner end of the first element, said surface of annular segment including a spherical socket depression complementally configured to said spherical section of the first element.

* * * * *